United States Patent [19]

Gronau et al.

[11] 4,233,971

[45] Nov. 18, 1980

[54] RESPIRATOR

[75] Inventors: Manfred Gronau; Werner Mascher; Klaus Pampuch, all of Berlin, Fed. Rep. of Germany

[73] Assignee: Auergesellschaft GmbH, Berlin, Fed. Rep. of Germany

[21] Appl. No.: 17,732

[22] Filed: Mar. 5, 1979

[30] Foreign Application Priority Data

Jun. 16, 1978 [DE] Fed. Rep. of Germany ..... 2827079

[51] Int. Cl.[3] ..... A62B 7/08

[52] U.S. Cl. ..... 128/202.26; 128/205.12; 128/205.28

[58] Field of Search ..... 128/191 R, 147, 142 R, 128/202, 202.26, 205.12, 205.28

[56] References Cited

U.S. PATENT DOCUMENTS 3,277,890 10/1966 Warncke ..... 128/202 X 3,397,693 8/1968 Warncke ..... 128/191 R

FOREIGN PATENT DOCUMENTS 306854 6/1971 U.S.S.R. ..... 128/191 R 368866 7/1973 U.S.S.R. ..... 128/191 R

*Primary Examiner*—Henry J. Recla

*Attorney, Agent, or Firm*—Brown, Flick & Peckham

[57] ABSTRACT

A ring-shape connecting member is disposed in an opening in the bottom of a breathing bag, where it is encircled and tightly engaged by an elastic sleeve secured to the bag around its opening and projecting downwardly out of the bag. A chemical cartridge is provided with an upwardly extending ring-shape flange projecting up into the elastic sleeve in sealing engagement with it, and the top of the cartridge within said flange is provided with an opening communicating with the connecting member.

5 Claims, 3 Drawing Figures

RESPIRATOR

This invention concerns a respirator consisting of an exchangeable oxygen-producing and carbon dioxide-binding chemical cartridge, and a breathing hose and a breathing bag.

Respirators are known which are fitted with chemical cartridges that can be changed rapidly without tools. West German DT-AS No. 1 209 434 describes a respirator which, between the cartridge and the breathing bag, and also between the cartridge and the breathing hose, is provided with a coupling member that is fitted with valves, the purpose of which is to control the exhaled air stream in different ways with the cartridge coupled or uncoupled. The purpose of that form of construction is to enable cartridges to be exchanged and to keep the breathing circuit closed when the cartridges are uncoupled. This, of necessity, requires a complicated form of construction and an appreciable over-all height which is objectionable, for example, in the case of self-rescue equipment that is worn by a person.

DT-OS No. 2 603 531 discloses additional respirator constructions with exchangeable cartridges. On the one hand, that equipment requires a form of construction in which the chemical cartridge is provided with additional sheathing, and it also requires a form of construction with coupling plates between the breathing bag and the cartridge. With such an arrangement, the multiple centering of the coupling parts and the large sealing band between the coupling plate and the cartridge constitute a drawback.

In addition, a respirator has been disclosed fitted with a chemical cartridge which, in a further development of the construction that involves additional sheathing of the cartridge, the cartridge/sheath/breathing hose connection lies concentrically within the sheath/breathing bag connection (P 27 26 405.7-22). The sheath, breathing bag and breathing hose are firmly connected together. The chemical cartridge is made as an exchangeable cartridge based on DT-OS No. 2 603 531.

The basic objective of the present invention is to create a simple, safe and space-saving exchange system for the chemical cartridge of a respirator. This objective is attained in accordance with the invention by providing a ring-shaped connecting member that extends into the breathing bag for connecting the chemical cartridge to the breathing hose and to the breathing bag, the arrangement being such that the connecting member is encircled by an elastic sleeve, the outer end of which projects out of the breathing bag. The connecting member serves as a central connecting point for connecting the breathing bag to the chemical cartridge, with the junction between the chemical cartridge and the breathing hose located inside the chemical cartridge breathing bag connection.

The advantages gained with the invention reside especially in the fact that the chemical cartridge and the breathing bag can be united simply by pushing them together, while, in order to change the chemical cartridge, all that is necessary is to release a fastener that can be operated from the outside.

Moreover, as a result of the form of the elastic sleeve, a connection is obtained between the breathing bag and the cartridge, which requires no special centering and which nevertheless ensures a tight union. The second connection between the cartridge and the breathing hose can be effected stress-free and sealed.

By the arrangement of the connecting member, which is partly inside the breathing bag, a cartridge exchange system is obtained that does not require a greater over-all height than that necessary for a solid connection between the cartridge and the breathing bag. In addition, the fasteners that are not released when separating the cartridge from the breathing bag unit lie inside the breathing bag, while only a single clamping ring lies exposed on the outside of the bag.

The preferred embodiment of the invention is illustrated in the appended drawings showing a respirator with two-way respiration.

Figure 1:
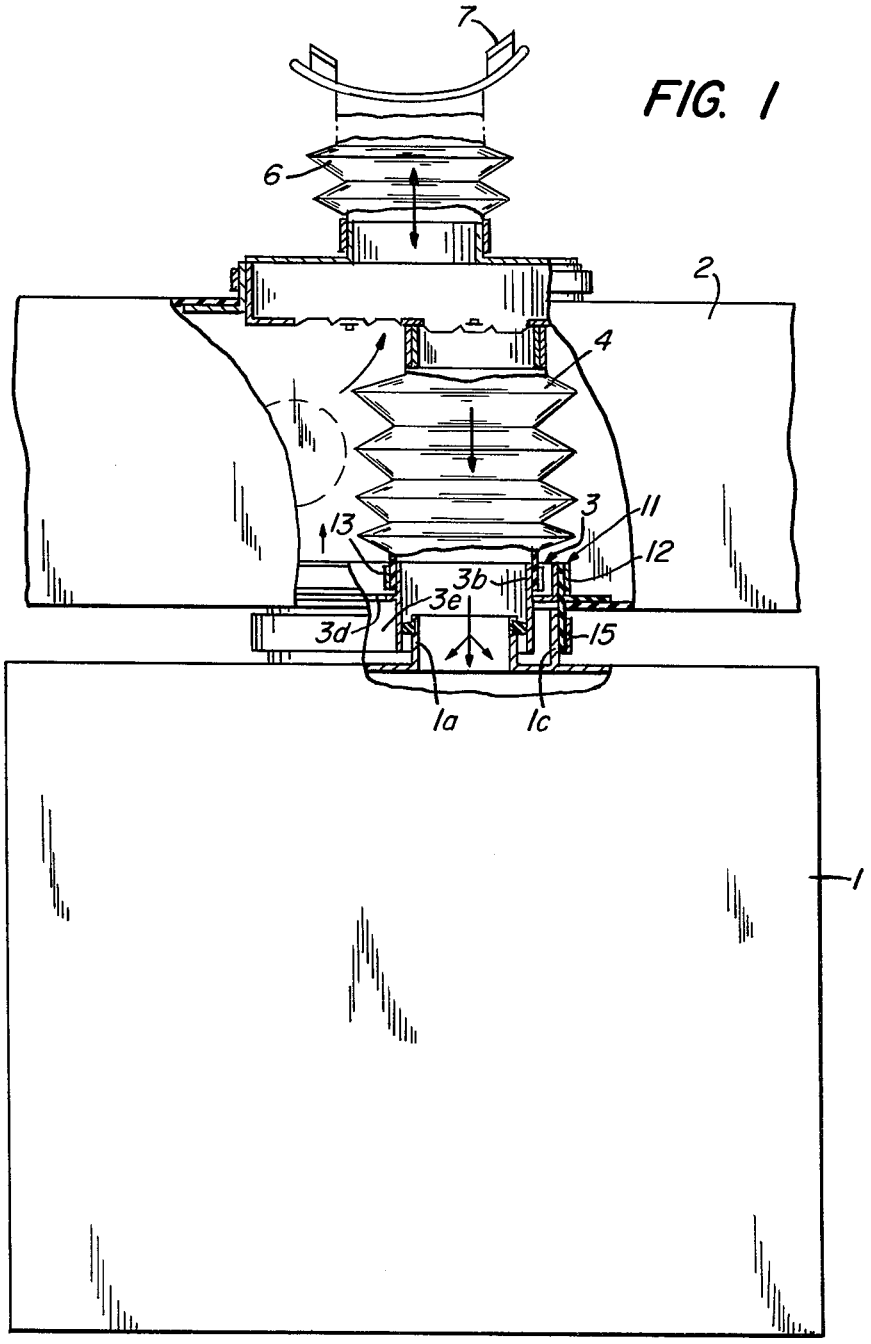
FIG. 1 is a fragmentary front view, partly in section, of a respirator constructed in accordance with the invention.
Figure 2:
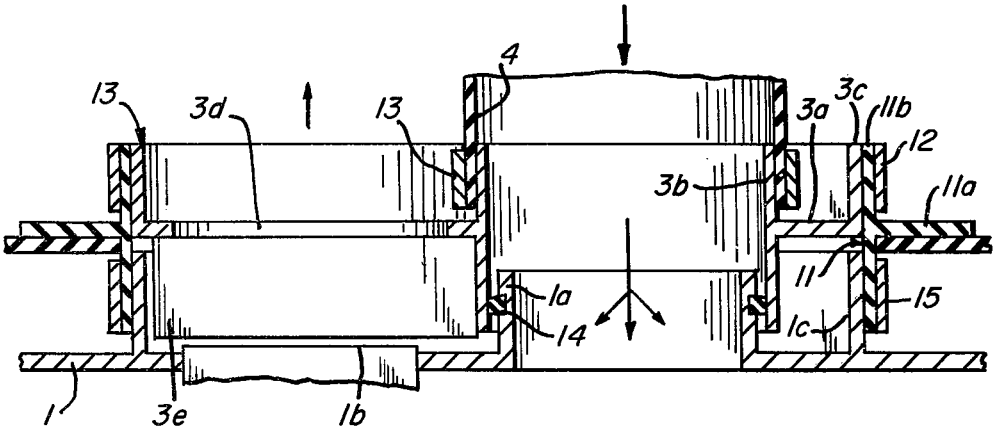
FIG. 2 is an enlarged vertical section of the connection between the breathing bag and hose and the chemical cartridge.
Figure 3:
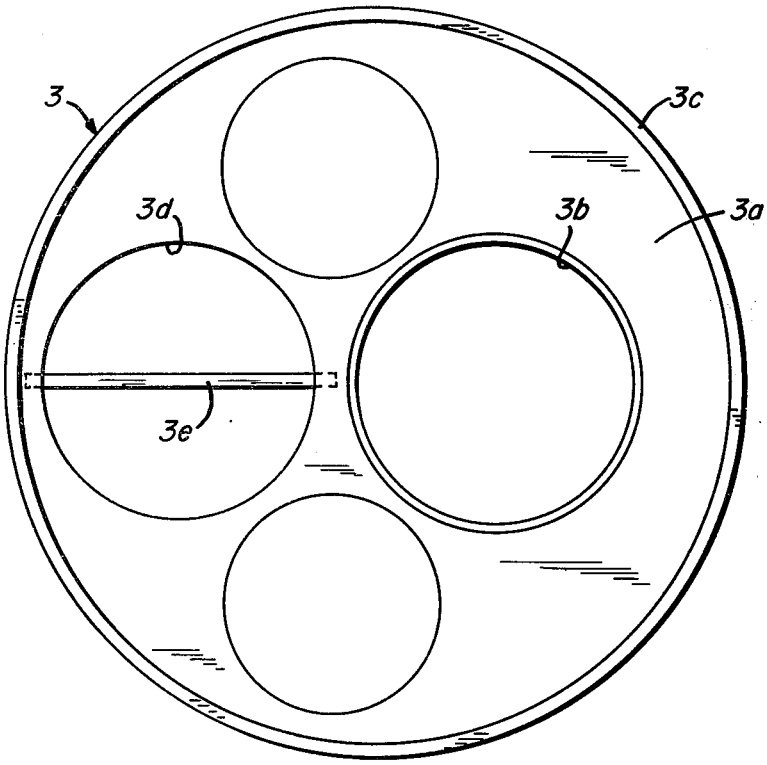
FIG. 3 is a plan view of the connecting member itself.

As may be seen from FIG. 1, the respirator consists essentially of an oxygen-producing and carbon dioxide-binding chemical cartridge 1, a breathing bag 2 that is connected via a connecting member 3 to the chemical cartridge, an exhalation breathing hose 4 that likewise is connected with the chemical cartridge, and an additional inhalation-exhalation breathing hose 6 fitted with a mouthpiece 7.

The connection of the chemical cartridge 1 to the breathing hose 4 is effected by the pot-shaped connecting member 3 located inside the lower part of the breathing bag 2. The connecting member has a base **3*a* provided with an opening, through which extends a tubular part 3*b* that projects above and below the base. The base and tubular part are joined together, such as by being molded in one piece. The connecting member also has an upwardly extending side wall 3*c* encircled by an elastic sleeve 11 held tightly against the side wall by a clamping ring 12. In addition, the base 3*a* of the connecting member is provided with one or more passages 3*d* in communication with outlet opening 1*b* in the top of the chemical cartridge 1**.

The elastic sleeve 11 has a T-shaped profile in vertical section, with its horizontal arm **11*a* overlying and secured to the interior side of the bottom of breathing bag 2. The vertical arm of the T takes the form of a flange 11*b* encircling the side wall 3*c* of the connecting member and also encircling and engaging a continuous flange 1*c*** extending upwardly from the top of the chemical cartridge.

The tubular part **3*b* serves as the connector for the encircling lower end of breathing hose 4, which is attached to part 3*b* inside the breathing bag by a clamping ring 13**.

OPERATION

The connection of the chemical cartridge 1 to the breathing bag unit is effected by pushing the short connecting tube **1*a*, which is around the inlet opening of the chemical cartridge, up into the lower end of the tubular part 3*b* of the connecting member. In doing so, flange 1*c* on the cartridge slips up into elastic sleeve 11, and the passages 3*d* in the connecting member are positioned above the passage 1*b* of the cartridge. A sealing ring 14, recessed into the outside of cartridge tube 1*a*, engages the inside of tubular part 3*b***.

The breathing bag 2 is then connected in a secure and seal-tight manner with the connecting flange **1*c* of the chemical cartridge by means of a releasable clamping ring 15 that encircles elastic sleeve 11 between the bag and cartridge. This exposed ring may be in the form, for example, of a hose clamp. This arrangement provides for a most rapid and problem-free exchange of the chemical cartridge because, in the event that the chemical cartridge needs to be replaced, the clamping ring 15 is simply released to relieve the radial pressure on the elastic sleeve, and the chemical cartridge then is pulled away from connecting member 3**.

A rib 3*e* is molded on the bottom of the base 3*a* of the connecting member directly above outlet opening 1*b* in the canister in order that, on inserting a new chemical cartridge, connecting tube 1*a* will mate with the tubular part 3*b* and exclude any other position. That is, if the cartridge is turned relative to the breathing bag while trying to connect them, rib 3*e* will strike against the flange 1*c* of the cartridge and prevent the connection until cartridge tube 1*a* is in the correct position. This anti-twisting arrangement is unnecessary when the tubular part 3*b* and the cartridge tube 1*a* are arranged concentrically with connecting member 3, an arrangement that is equally possible.

The above-described exchanging system for chemical cartridges is suitable both for respirators with two-way respiration and for respirators with one-way respiration (rhythmic or cyclic respiration).

We claim:

1. A respirator comprising a breathing bag with an opening in its bottom, a rigid ring-shape connecting member inside the bag at said opening, an elastic sleeve encircling and tightly engaging said connecting member inside the bag, said sleeve being secured to the bag around said bag opening and projecting downwardly out of the bag, said connecting member having a base provided with an opening therethrough, a tubular member rigidly disposed in said base opening and extending above and below it, a chemical cartridge below said bag provided with an upwardly extending ring-shape flange projecting up into said elastic sleeve in sealing engagement therewith, the top of the cartridge within said flange having an inlet opening therein, a rigid tube extending from said inlet opening up into concentric relation with the lower end of said tubular member, a breathing hose inside the bag having a lower end connected to the upper end of said tubular member, and means for connecting the upper end of said hose with a breathing hose outside of the bag, said connecting member base being provided with an opening therethrough beside said tubular member, and the top of the cartridge within said flange having an outlet opening beside said tube.

2. A respirator according to claim 1, in which said elastic sleeve holds said connecting member in place.

3. A respirator according to claim 1, including a releasable clamping ring below the breathing bag encircling said downwardly projecting part of the elastic sleeve and clamping it against said cartridge flange to fasten the cartridge and breathing bag together, said clamp being exposed for manual release of the clamping pressure when it is desired to remove the cartridge.

4. A respirator according to claim 1, in which the lower end of the breathing hose encircles the upper end of said tubular member, the respirator including a clamping ring inside the breathing bag pressing said hose against said tubular member, and a clamping ring inside the bag pressing said elastic sleeve against said connecting member.

5. A respirator according to claim 1, in which said tubular member is located off-center relative to said connecting member, and said connecting member is provided with an element projecting downwardly substantially into engagement with the inside of said cartridge flange to prevent said bag and cartridge from turning relative to each other.

* * * * *